US008262142B2

(12) United States Patent
Ramsauer

(10) Patent No.: US 8,262,142 B2
(45) Date of Patent: Sep. 11, 2012

(54) SECURABLE FASTENING DEVICE

(76) Inventor: Dieter Ramsauer, Schwelm (DE)

( * ) Notice: Subject to any disclaimer, the term of this patent is extended or adjusted under 35 U.S.C. 154(b) by 854 days.

(21) Appl. No.: 12/224,107

(22) PCT Filed: Dec. 1, 2006

(86) PCT No.: PCT/EP2006/011568

§ 371 (c)(1),
(2), (4) Date: Aug. 27, 2008

(87) PCT Pub. No.: WO2007/093207

PCT Pub. Date: Aug. 23, 2007

(65) Prior Publication Data

US 2009/0160199 A1 Jun. 25, 2009

(30) Foreign Application Priority Data

Feb. 18, 2006 (DE) ..... 20 2006 002 592 U

(51) Int. Cl.
*E05C 1/08* (2006.01)

(52) U.S. Cl. ..... 292/163; 292/164; 292/302

(58) Field of Classification Search ..... 292/138, 292/164, 163, 37, 33, 157, 137, 32, 169, 292/140, 150, 302; 411/347
See application file for complete search history.

(56) References Cited

U.S. PATENT DOCUMENTS

| | | | | |
|---|---|---|---|---|
| 177,556 | A * | 5/1876 | Powelson | 292/37 |
| 1,426,239 | A * | 8/1922 | Witzberger | 411/385 |
| 2,397,225 | A * | 3/1946 | Walters | 292/194 |
| 3,561,516 | A * | 2/1971 | Reddy | 411/347 |
| 7,600,794 | B2 * | 10/2009 | Ramsauer | 292/163 |
| 2006/0283217 | A1 * | 12/2006 | Ramsauer | 70/162 |
| 2007/0062004 | A1 * | 3/2007 | Ramsauer | 16/370 |
| 2007/0175252 | A1 * | 8/2007 | Ramsauer | 70/370 |
| 2008/0060401 | A1 * | 3/2008 | Ramsauer | 70/370 |
| 2009/0160199 | A1 * | 6/2009 | Ramsauer | 292/256 |

FOREIGN PATENT DOCUMENTS

| | | |
|---|---|---|
| WO | 2005/071199 | 8/2005 |
| WO | 2005/083207 | 9/2005 |
| WO | 2005/083209 | 9/2005 |
| WO | 2005/083275 | 9/2005 |
| WO | WO 2005083209 A1 * | 9/2005 |

* cited by examiner

*Primary Examiner* — Thomas A Beach
*Assistant Examiner* — Mark Williams
(74) *Attorney, Agent, or Firm* — Frommer Lawrence & Haug LLP

(57) ABSTRACT

A clampable fastening device for mounting fittings or other objects in an opening having opposite edges, such as a rectangular opening in a wall, including a head part which is arranged on the outer side of the thin wall and which covers the outer rim of the opening, and from which there proceeds in the mounted position a foot part which penetrates through the opening, holding elements which are displaceable relative to one another in a channel formed in the foot part project from the foot part in direction of its outer surface. The free end of the holding elements having an inclined surface or obliquely arranged points. Wherein the foot part and the holding element are separate parts. Wherein the holding elements are displaceable along the channel by a screw preferably having a conically shaped region.

44 Claims, 5 Drawing Sheets

Fig. 2
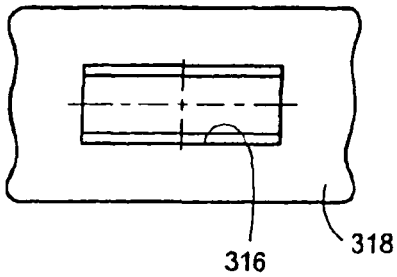
Fig. 3
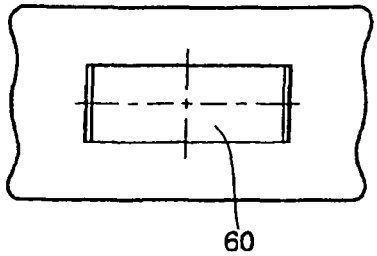
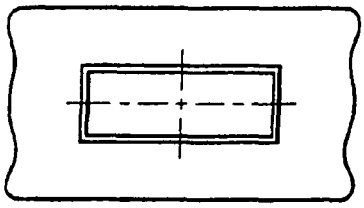
Fig. 4
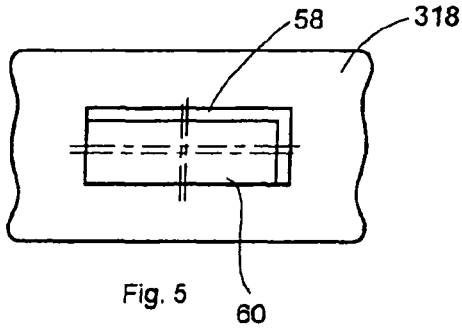
Fig. 5
Fig. 6A
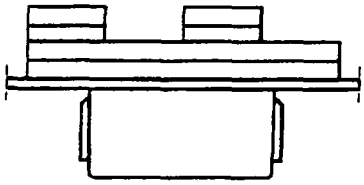
Fig. 7
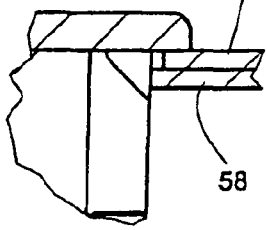
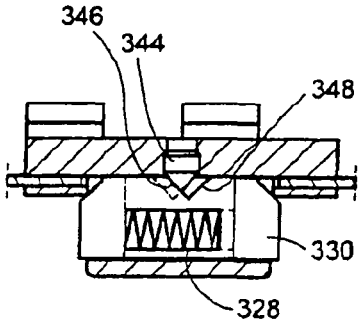
Fig. 6B
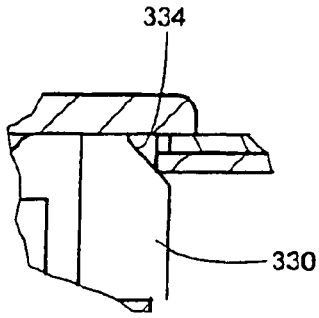
Fig. 8

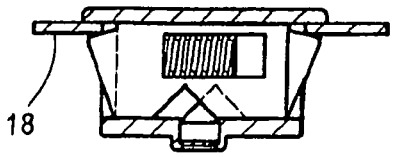
Fig. 9A
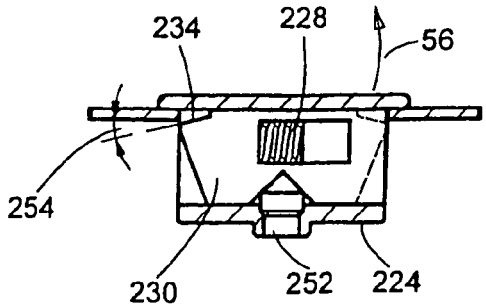
Fig. 9B
Fig. 10A
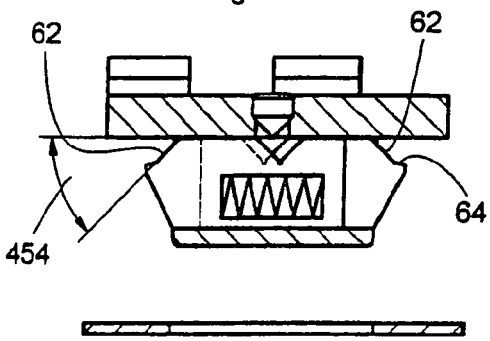
Fig. 10C
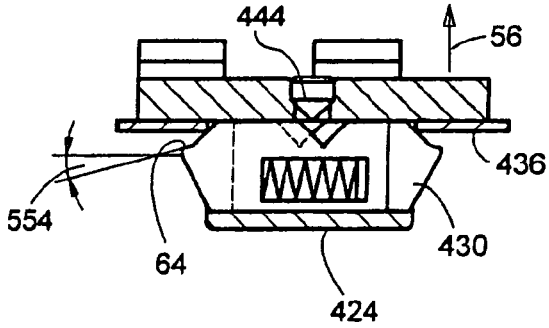
Fig. 10B
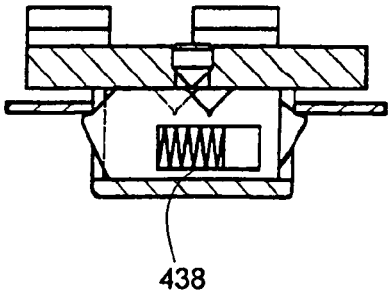
Fig. 10D
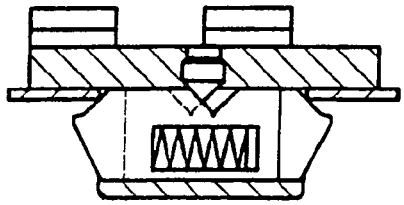

SECURABLE FASTENING DEVICE

The present application claims priority from PCT Patent Application No. PCT/EP2006/011568 filed on Dec. 1, 2006, which claims priority from German Patent Application No. 20 2005 002 592.8 filed on Feb. 18, 2006, the disclosure of which is incorporated herein by reference in its entirety.

BACKGROUND OF THE INVENTION

1. Field of the Invention

The invention is directed to a clampable fastening device for mounting fittings or other objects in an opening or recess having opposite edges or walls, such as a rectangular opening or recess in a thin or thick wall such as sheet metal or a wooden board, comprising a head part which is to be arranged on the one, outer side of the thin or thick wall and which covers the outer rim of the opening or recess and from which there proceeds in the mounted position a foot part which penetrates through the opening or which projects into the recess, holding elements which are displaceable relative to one another against or with spring force in a channel formed in the foot part project from the foot part in direction of its outer surface, the free end of the holding elements having an inclined surface for supporting the foot part without play on the rim or edge of the opening of the other, inner side of the thin wall or obliquely arranged points for penetrating into the wall surface of the opening or recess of the thick wall, wherein the foot part and the holding element are two separate parts, wherein the holding elements are displaceable by means of a screw which is preferably conically shaped.

2. Description of Related Art

A clampable fastening device for mounting fittings or other objects in an opening having opposite edges in a thin wall such as sheet metal is already known from WO 2005/083209 A1, FIGS. 26A and 26B and the accompanying description on page 22, paragraph 1. In the known arrangement, two holding elements 736 are pressed apart by a conical screw 98 resulting in a particularly strong holding force. However, the screw head is only accessible from the interior of the cabinet and a blind fastening is therefore out of the question. A similar arrangement is disclosed in WO 2005/071199 A1.

SUMMARY OF THE INVENTION

It is the object of the invention to further develop the known fastening device and to make it universally useable.

The object is met in that the holding elements are plates which are arranged next to one another or, alternatively, one behind the other and are elongated in the direction of displacement and which jointly or, alternatively, by themselves form with the channel walls a receiving space for receiving a compression spring, which receiving space extends in the direction of displacement and becomes smaller when the plates are displaced from their rest position and, as a result, compresses the spring, in that the conically shaped screw(s) has (have) a conically shaped foot, and in that the plates have, in the vicinity of one end of their longitudinal extension, first inner inclined surfaces which cooperate with the conical foot of the screw and which are offset with respect to one another in the rest position of the plates but move away from one another when the plates are displaced into the working position.

Due to the fact that the plates which are elongated in the direction of displacement in a thin wall jointly form a receiving space for receiving a spring, which receiving space extends in the direction of displacement and becomes smaller when the plates are displaced from their rest position, thereby compressing the spring, the fastening device can be mounted and removed in a simpler manner because, owing to the spring pressure, the elongated plates automatically retract or advance by loosening the screw without the need for any special steps. Further, the plates combined with the springs can be handled like an individual part which facilitates the mounting of the fastening device as such to form a unit.

Because the conical shape of the screw has a conically shaped foot, the screw is shorter overall and, therefore, the structural height of the clampable fastening device can be reduced.

A particularly stable connection and clamping of the fastening device with the thin or thick wall can be achieved through the force of the screw in that the plates have, in the vicinity of one end of their longitudinal extension, first inner inclined surfaces which cooperate with the conical foot of the screw and which are only slightly offset with respect to one another in the rest position of the plates but move away from one another when the plates are displaced into the working position. The fixed clamping also makes it possible to carry out adjustments in longitudinal direction or, if required, also in transverse direction with respect to the fitting as may be desirable, for example, with hinges. This is not provided in other fastening devices, e.g., those described in the above-cited reference, in which a play-free positive engagement is produced between the foot part and the opening that does not permit adjustability.

Further, the construction according to the invention provides for an arrangement in which blind mounting is possible.

Another advantage consists in that the arrangement according to the invention remains in the open position when, e.g., a plurality of hinges must be moved into the releasing position simultaneously so that the door leaf can be removed from the frame.

Finally, another advantage of the arrangement according to the invention consists in that grounding, i.e., a metal-to-metal connection between the metal hinge or other fitting parts and the metal wall, can be achieved automatically in a simple manner.

In a further development of the fastening device according to the invention in which a thin wall is provided, the plates have, respectively, in the vicinity of the other end of their longitudinal extension, outer inclined surfaces which cooperate with the edge of the opening in the thin wall and which lie within the foot part in the rest position of the plates relative to one another but which move out of the body part and away from one another when displaced into the working position. Alternatively, in case of the thick wall, the plates can have, at the respective other end of the longitudinal extension, outer inclined surfaces or teeth which cooperate with the wall of the opening or recess in the thick wall, and these plates lie inside the foot part when the plates are positioned in the rest position relative to one another but move out of the foot part and away from one another when displaced into the work position.

The plates can form second inner inclined surfaces, respectively, which adjoin the first inner inclined surfaces in such a way that they both form a free space receiving the conical region of the screw. A particularly simple and stable design is made possible in this way.

The screw can be a headless screw, which reduces the space requirement and permits particularly small embodiment forms for the fastening device.

The screw can be arranged in a threaded bore hole formed by the head part. Alternatively, the screw can be arranged in a threaded bore hole formed by the foot part.

According to a further development of the invention, it is advantageous when the end bevels of the holding elements are inclined with respect to the wall plane in such a way that when a force component perpendicular to the wall plane is directed away from the latter the holding elements are displaced against spring force in a direction parallel to the wall plane, in which case the angle is approximately 45 degrees and no self-locking phenomena occur. Alternatively, the end bevels of the holding elements can be inclined with respect to the wall plane in such a way that when a force component perpendicular to the wall plane is directed away from the latter the holding elements cannot be displaced against spring force, in which case the angle is substantially less than 45 degrees and self-locking phenomena play a part.

A rectangular auxiliary plate having a rectangular aperture that is somewhat smaller in longitudinal direction and/or in transverse direction than the aperture in the thin wall can be provided. This offers adjustment possibilities which can be advantageous particularly in hinge applications.

The inclined surfaces of the plates which are displaceable relative to one another, which inclined surfaces cooperate with the conical screw, can be arranged in such a way that when the conical screw is tightened the plates are moved away from one another against spring force, but when the conical screw is loosened the plates are moved toward one another with the spring force. This facilitates mounting and disassembly.

However, the inclined surfaces of the plates which are displaceable relative to one another, which inclined surfaces cooperate with the conical screw, can also be arranged in such a way that when the conical screw is tightened the plates are moved toward one another against spring force, but when the conical screw is loosened the plates are moved away from one another with the spring force. This represents an alternative.

The end bevels of the holding elements in a first region can be inclined with respect to the wall plane in such a way that when a force component perpendicular to the wall plane is directed away from the latter the holding elements are displaced against spring force, in which case no self-locking occurs and the angle is approximately 45 degrees, but in a second region has a smaller angle which leads to self-locking. This again facilitates mounting because it affords a certain possibility of pre-mounting.

It may also be advantageous when the two end bevels of the holding elements with their different inclinations with respect to the wall plane are arranged in such a way that when the foot part is pulled out the region not having self-locking becomes operative first and the self-locking region becomes operative only afterward.

The fastening device can be part of a hinge for a thin-walled door such as a metal door or for a thick-walled door such as a wooden door. Alternatively, the fastening device can be part of a handle for a thin wall such as a metal wall or for a thick wall such as a wooden wall. Finally, it is also conceivable that the fastening device is part of a closure for a thin door such as a metal door or a thick door such as a wooden cabinet door.

Finally, it is possible that the fastening device is part of a device that is provided with a head and used for fastening a first wall to a second, thin (metal) wall or thick (wooden) wall. The bevels for fastening the body part to the thin wall can be roughened, scored or grooved to achieve a partial positive engagement or for purposes of grounding.

According to a further development of the fastening device, the edge of the opening of the thin wall that is struck by the inclined surface of the fastening element is beveled for adapting to the inclination of the inclined surface so as to reduce contact stress.

When the fastening elements are arranged one behind the other, the free space located between them can advantageously be used for arranging the fitting devices such as the actuating shaft of a sash fastener.

With self-locking fastening elements, a procedure is possible in which the screw with conically shaped region is screwed in only to release the fitting. In this case, the screw with conically shaped region can have the shape of a tool such as a simple screwdriver or (if forces are not too large) a screwdriver with a screw fitted thereto.

Instead of a screw with conically shaped region, a simple cylindrical screw can also sometimes be sufficient if the resulting higher contact stress does not interfere.

BRIEF DESCRIPTION OF THE DRAWINGS

FIG. 2 shows a top view of a thin wall with an opening in which an auxiliary plate makes it possible to carry out a transverse adjustment in the opening.

FIG. 3 shows a similar arrangement, but in which an auxiliary plate is used for longitudinal adjustment.

FIG. 4 shows an arrangement in which a transverse adjustment and a longitudinal adjustment is possible.

FIG. 5 shows a view illustrating the adjustability in longitudinal direction and transverse direction.

FIG. 6A is a side view of a hinge arrangement in which an auxiliary plate results in adjustability.

FIG. 6B shows an axial sectional view of the arrangement according to FIG. 6A.

FIGS. 7 and 8 show a magnified view of the arrangement according to FIG. 6B for a closer explanation of their function, wherein the auxiliary plate is not clamped in FIG. 7, but is clamped in FIG. 8.

FIGS. 9A and 9B show an arrangement in cross section in which spring-supported holding elements can be tightened against spring pressure by means of conical screws.

FIGS. 10A, 10B, 10C and 10D show an arrangement in which a spring-supported group of holding elements or snap elements are provided for pre-mounting, wherein no self-locking forces occur, subsequent penetration of the conical screw clamps the elements and allows a greater loading such as, for example, in an automobile door.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1B:
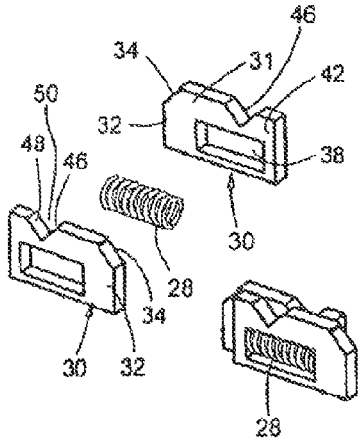
FIG. 1B is an exploded view of the different component parts of the hinge arrangement shown in FIG. 1A.
Figure 1A:
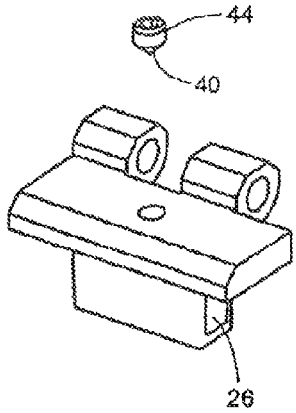
FIG. 1A shows a perspective view of a clampable fastening device in the form of a hinge prior to mounting in an opening in a thin wall.
Figure 1A:
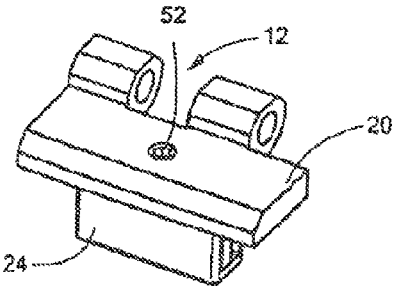
Figure 1C:
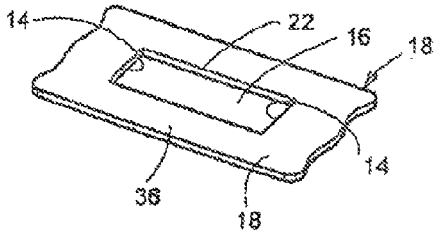
FIG. 1C is a side view of the hinge arrangement according to FIG. 1A in which the plates are retracted.
Figure 1C:
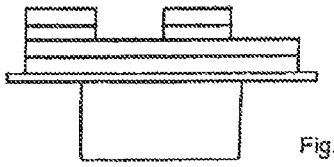
Figure 1E:
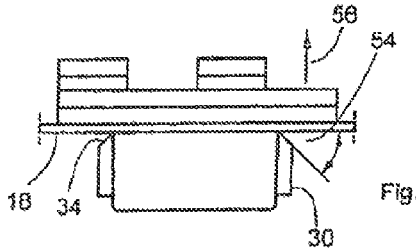
FIG. 1E is a side view of the arrangement according to FIG. 1A in which the plates are pushed out.
Figure 13:
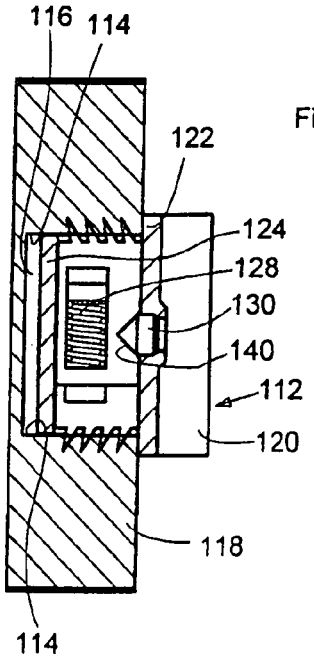
FIG. 13 is a sectional view showing an embodiment form which is suitable for thick walls.
Figure 14:
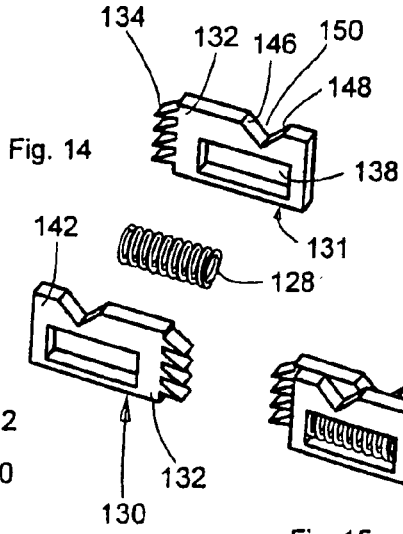
FIG. 14 shows the two associated plates which can be clamped by a screw against spring force.
Figure 15:
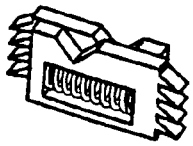
FIG. 15 shows the unit formed of plates and spring after assembly.
Figure 16:
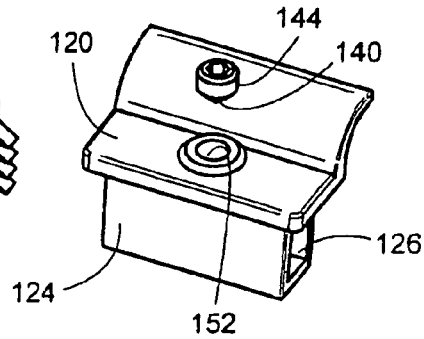
FIG. 16 shows the associated fitting part, in this case a handle, for example, in a perspective view according to FIGS. 14 to 16.

FIG. 1A is a perspective view showing a clampable fastening device 10 according to the invention for mounting a fitting such as a hinge 12 in an opening 16 in a thin wall 18, which opening 16 has opposite edges or walls 14, or, alternatively (see FIG. 13), for mounting in a recess or opening 116 in a thick wall 118, which recess or opening 116 has opposite walls 114. The thick wall can be a wooden board, or the thin wall can be sheet metal. The fastening device comprises a head part 20, 120 which is to be arranged on the one, outer side of the thick or thin wall 118, 18 and which covers the outer rim of the opening or recess 22, 122. Proceeding from the head part 20, 120 in the mounted position, a foot part 124, 24 projects into the recess or penetrates through the opening. Holding elements 30, 130, 31, 131 which are guided in a channel 26, 126 and displaceable relative to one another against or with spring force 28, 128 project from the foot part 24, 124. The free end 32, 132 of the holding elements 30, 130, 31, 131 has an inclined surface 34 or obliquely arranged points 134 for supporting the foot part 24 and, therefore, the head part 20 without play on the rim or edge 22, 14 of the opening 16 on the other, inner side 36 or for the penetration of the points 134 into the wall surface 136 of the recess in the thick wall 118. As can be seen, the foot part 24 or 124 and holding element 30 or 130 are separate parts. The holding elements 30, 130 are displaceable along the channel 26, 126 by means of a conically shaped screw 38, 138. As can be seen from the exploded view in FIG. 1B (see also the corresponding view in FIG. 14), the holding elements 30, 130 are plates which are arranged next to one another, elongated in the direction of displacement and jointly form a receiving space 38, 138 for a compression spring 28 or 128, which receiving space 38, 138 extends in the direction of displacement and becomes smaller when the plates 30, 130 are displaced from their rest position and, as a result, compresses the spring 28, 128 as can be seen from FIGS. 1F and 13. The conically shaped screw 44, 144 has a conically shaped foot 40, 140. The cone angle is, for example, 2×45 or 90 degrees, but can also be a different angle if required. The plate-shaped holding elements 30, 130 have in the vicinity of their respective one end of the longitudinal extension (reference number 142) a first inner inclined surface 46, 146 cooperating with the conical foot 40, 140 of the screw 44, 144. These first inner inclined surfaces 46, 146 are only slightly offset relative to one another in the rest position of the plates 30, 130 but move away from one another by the action of the conical surface of the screw when displaced into the working position (compare FIGS. 1D and 1F).

The plates have in the vicinity of their respective other end of the longitudinal extension 32 and 132 an outer inclined surface 34 which cooperates with the edge 14 of the thin wall 18. These outer inclined surfaces 34 lie within the channel 26 of the body part 24 (shown in FIGS. 1C and 1D) when the plates 30, 130 are in their rest position relative to one another but move out of the channel 26 of the foot part 24 and away from one another (shown in FIGS. 1E and 1F) when displaced into the working position. This movement compresses the spring 28 so that the movement back is carried out by spring force when the screw is loosened, and the plates again disappear into the channel, which carries out a movement leading from the view shown in FIG. 1E or 1F to the position shown in FIGS. 1C and 1D. When used as a hinge, for example, as is shown in the drawings, this has the advantage that the holding elements automatically retract by loosening the screw 44. Accordingly, no special steps need be undertaken to keep the holding elements in this retracted position and, therefore, to facilitate the removal of a door from its hinges.

Figure 1D:
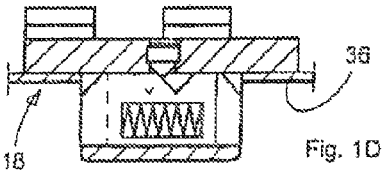
FIG. 1D shows the arrangement according to FIG. 1C, but in axial section.
Figure 1F:
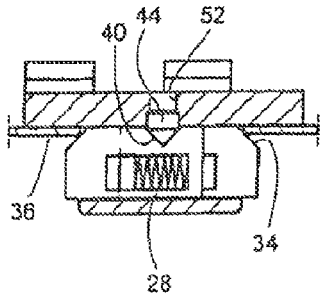
FIG. 1F shows the arrangement according to FIG. 1E, but in axial section.
Figure 11A:
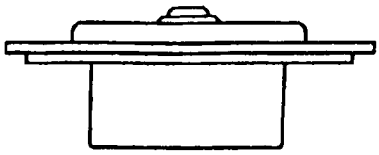
FIGS. 11A, 11B and 12A, 12B are side views and axial sectional views through an embodiment form in which the screw arrangement is carried out on the front side so that a blind mounting is possible.
Figure 12A:
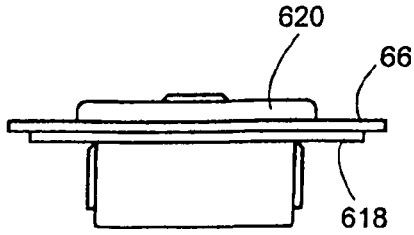
Figure 11B:
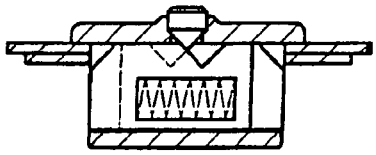
Figure 12B:
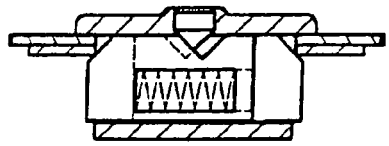

The plates or holding elements 30, 130 also have a second inner inclined surface 48 and 148 which adjoins the first inner inclined surface 46, 146 in such a way that the two of them form a free space 50, 150 receiving the conical region, in this instance the conical foot 40, 140, of the screw 44, 144. The free space is advisably shaped in such a way that it can receive the cone region 40 of the screw 44 without play. The two openings 38 of the plates 30 lying next to one another are also arranged in such a way that, in the rest position, they leave a small common triangular region 52 for the two triangular notches 50, into which common triangular region 52 the point of the conical screw 40 can penetrate as is shown in FIG. 1D. When the screw is tightened further, it penetrates deeper and pushes the two holding elements apart until a clamping with the rim areas of the thin wall 36 takes place. Maximum displacement is achieved when the cone-shaped screw 40 has brought the two triangular notches into alignment.

A headless screw, as is designated in the drawings at 130, 30, requires the least space. In the embodiment forms shown in FIG. 1A, as in the embodiment form shown in FIG. 13, this headless screw is screwed into a threaded bore hole 52, 152 which is formed by the respective head part 20, 120 and which opens into the channel 26 of the foot part 226.

A blind mounting is possible with this arrangement. If this is not required, the screw can also be arranged in a threaded bore hole formed by the foot part. This possibility is indicated in FIGS. 9A, 9B.

The end bevels 34 of the holding elements 30 can be arranged in such a way with respect to the wall plane (see the thin wall 36 and its contact surface) that no self-locking occurs. The end bevels 34 of the holding elements 30 are preferably inclined with respect to the wall plane 18 (see 54 in FIG. 1E) in such a way that when a force component 56 perpendicular to the wall plane is directed away from the latter the holding elements 30 are displaced against spring force 28 in a direction parallel to the wall plane, i.e., they move back from the position shown in FIG. 1E into the position shown in FIG. 1C. Accordingly, at the angle shown at 54, there is no self-locking of the holding elements within the channel as would be the case with substantially smaller angles. Such a case is shown in FIGS. 9A and 9B. In this instance, end bevels 234 of the holding elements 230 are inclined with respect to the wall plane 18 (see angle 254) in such a way that when a force component 56 perpendicular to the wall plane is directed away from the latter the holding elements 230 cannot be displaced against the spring force of the spring 228 because self-locking occurs, which is the case at an angle 254 of substantially less than 45 degrees, e.g., 30 degrees.

In FIGS. 2, 3, 4 and 5, a fastening device is provided with an opening 316 in a thin wall 318. There is an auxiliary plate 58 with a rectangular aperture 60 that is somewhat smaller in longitudinal direction (FIG. 3) or in transverse direction (FIG. 2) than the opening 316 in the thin wall 318. According to FIG. 4, the aperture 60 is somewhat smaller in both directions, in longitudinal direction as well as in transverse direction.

As can be seen in FIG. 6A, the thin wall 318 is clamped between the head of the fitting and the auxiliary plate so that the holding elements are not supported on the rims of the opening in the thin wall, but rather on those of the somewhat narrower opening in the auxiliary plate. This means that the fitting can be slid back and forth within the opening in the thin wall, for example, in order to provide possibilities for adjusting the hinge. These different displacement possibilities are shown in FIG. 5. The fitting is secured when the screw is tightened.

In the arrangement shown in FIG. 2, an adjustment transverse to the longitudinal extension of the opening is possible. In the arrangement shown in FIG. 3, an adjustment in the transverse direction is possible.

The inclined surfaces 346, 348 (see FIG. 6B) cooperating with the conical screw 344 with plates 330 which are displaceable with respect to one another are arranged in such a way that when the conical screw 344 is tightened the plates 330 are moved away from one another against spring force, but, when the conical screw is loosened, are moved toward one another with the spring force. Alternatively, the device can also be carried out in the reverse manner in such a way that the plates are moved toward each other against spring force when the conical screw is tightened and away from each other with the spring force when the conical screw is loosened.

In the embodiment form according to FIGS. 10A, 10B, 10C and 10D, the end bevels of the holding elements 430 in a first region 62 are inclined with respect to the wall plane 436 (see reference number 454) in such a way that when a force component 56 perpendicular to the wall plane is directed away from the latter the holding elements 430 can be displaced against the spring force of the spring 438, e.g., from the position shown in FIG. 10C to the position shown in FIG. 10B, and the edges of the opening in the thin wall 436 slide along the inclined surface and the holding elements press in against the force of the spring 438. Accordingly, having unscrewed the cone of a screw 444, the hinge can be loosened until a second region 64 of the inclined surface is reached, as is shown in FIG. 10B, this second region 64 having a smaller angle 554 leading to the self-locking, so that complete removal of the fitting part from the thin wall 436 is only possible when additional pressure is exerted on the holding elements 430 from the outside so that they enter entirely into their channel which is formed by the foot part of the fastening device.

This substantially facilitates mounting when the hinge is mounted in a thin wall, particularly when more than one hinge is mounted along a switch cabinet door where the hinge fittings are initially pre-mounted, i.e., inserted into corresponding openings along the stop edge of the door leaf, whereupon they no longer fall out through the region tending toward self-locking when the door is subsequently inserted into the cabinet frame which already has corresponding hinge parts. After the two hinge parts are connected, a clamping can be carried out subsequently through the penetration of the screw so that the holding elements are suitable for large loads, e.g., loading by an automobile door or the like.

By loosening a hinge through a conical screw according to the embodiment forms shown herein, it is possible for the snap-in elements which are to be retracted to be much narrower than in fastening parts that are opened by means of a key which must be pulled out as in the reference cited above in which a flat key is used. The solution using a flat key leads to appreciably broader plate parts.

The arrangement of a releasing key provided with a toothing has the disadvantage that no self-locking end position is achieved so that it is problematic to mount a plurality of fitting elements simultaneously.

The embodiment form according to FIGS. 11A, 11B, 12A and 12B serves as a fastening element for fastening one thin wall to another; thin walls corresponding to the required dimensions have rectangular openings. In the embodiment form, the conical screw is arranged in the head part so that a blind mounting according to FIG. 11A to FIG. 16 is possible.

Figure 17A:
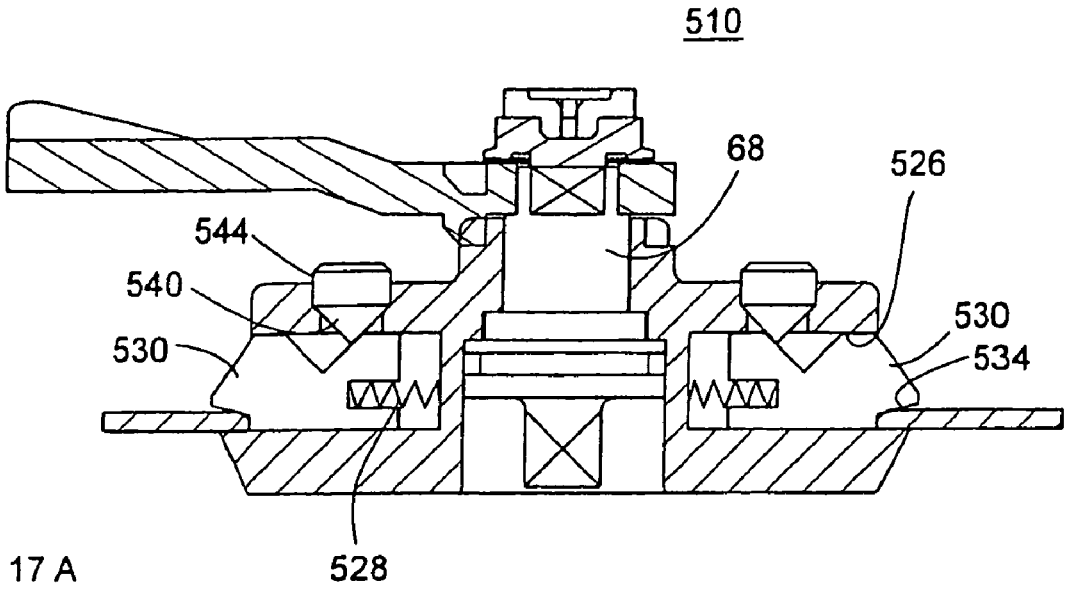
FIG. 17A shows an embodiment form of a fastening device in which (self-locking) fastening elements are arranged one behind the other and the free space located between them is used for the arrangement of an actuating shaft of a sash fastener.
Figure 17B:
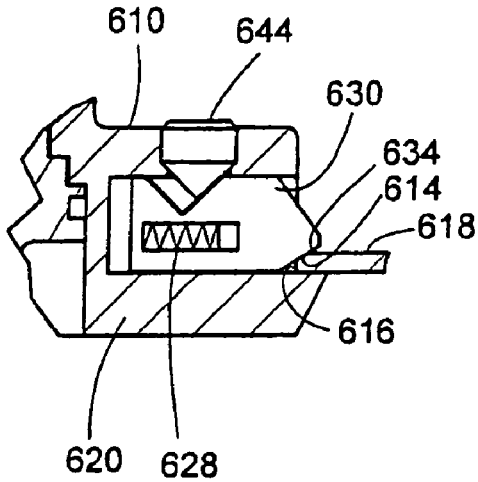
FIGS. 17B and 17C show an embodiment form similar to FIG. 17A, but with fastening elements which are not self-locking, in the clamping position in FIG. 17B and in the releasing position in FIG. 17C.

According to a further development of the fastening device shown in FIG. 17B, the edge 614 of the opening 616 of the thin wall 618 struck by the inclined surface 634 of the holding element or fastening element 630 is beveled to adapt to the inclination of the inclined surface in order to reduce the contact stress.

By arranging the fastening elements 530 one behind the other (see FIG. 17A), the free space located between them can advantageously be used for arranging fitting devices such as an actuating shaft 68 of a sash fastener.

In the case of self-locking fastening elements, as in FIG. 17A, a procedure is possible whereby the screw 544 is screwed in by a conically shaped region 540 only for releasing the fitting. In this case, the screw with the conically shaped region can have the shape of a tool such as a screwdriver with attached screw with a conical tip 540.

On the other hand, a remaining screw 544 serves to prevent fastening elements 530 under pressure by the spring 528 supported at the rear end of the channel 576 from falling out of the channel 526.

Figure 17C:
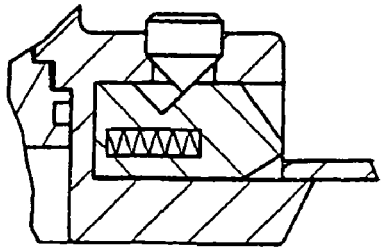

In FIGS. 17B and 17C, the spring is supported at a projection in the channel in the vicinity of its outlet, that is, it presses the fastening element inward.

The invention can also be used in fastening elements which generate a clamping action by means of oblique guidance, e.g., by means of pins which run in oblique grooves in the fastening elements (see FIGS. 36A to 36E of the above-cited WO 2005/071199 A1).

Commercial Applicability:

The invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10, 110, 510 fastening device
12, 112 fitting, hinge

14, 114, 514 edge, wall
16, 116, 316, 616 opening, recess
18, 118, 318, 618 thin wall, thick wall
20, 120, 620 head part
22, 122 outer edge of the opening or of the recess
24, 124, 224, 424 foot part
26, 126, 526 channel
28, 128, 228, 328, 438, 538, 638 spring (force)
30, 130, 230, 330, 430, 530, 630 holding element
32, 132 free end, other end of the longitudinal extension
34, 134, 234, 334, 534, 634 outer inclined surface; obliquely arranged points
36 inner side of the thin wall
38, 138 receiving space
40, 140, 540 conical foot
42, 142 end
44, 144, 344, 444, 544, 644 screw
46, 146, 346 first inner inclined surface
48, 148, 348 second inner inclined surface
50, 150 free space
52, 152, 252 threaded bore hole
54, 254 angle of inclination, end bevel
56 force component
58 auxiliary plate
60 aperture
62 first region
64 second region
66 second wall
68 actuation shaft

The invention claimed is:

1. A clampable fastening device for mounting fittings or other objects in an opening or recess of a wall, said fastening device comprising:

a head part which is to be arranged in a mounted position on a one outer side of the wall and which is intended to cover an outer rim of the opening or recess, a foot part which, in the mounted position, proceeds from the head part, and which is penetrable through the opening or which is projectable into the recess; and holding elements which are displaceable relative to one another, against or with a spring force, in a channel formed in the foot part;

wherein the holding elements project from the foot part along direction of an outer surface of the foot part;

wherein a free end of each of the holding elements has an inclined surface for supporting the foot part without play on a rim or edge of the opening of an other inner side of the wall, or each of the free ends of the holding elements has obliquely arranged points for penetrating into the wall surface of the opening or recess of the wall;

wherein the foot part and the holding elements are separate parts; wherein the holding elements are displaceable in a direction of displacement along the channel by means of a screw having a conically shaped region;

wherein the holding elements are plates which are arranged next to one another and are elongated in the direction of displacement, where the plates jointly form with the channel walls a receiving space for receiving a compression spring which provides the spring force;

wherein the receiving space extends in the direction of displacement and becomes smaller when the plates are displaced from a rest position and, as a result, compresses the spring;

wherein the conically shaped region of the screw includes a conically shaped foot;

wherein each of the plates has, near an end of the respective plate other than the respective free end, a first inner inclined surface and a second inclined surface, where at least one of the first inner inclined surface and the second inclined surface cooperates with the conical foot;

wherein the first inner inclined surfaces are offset with respect to one another in the rest position of the plates but move towards each other when the plates are displaced into a working position;

wherein each of the plates has, at the free end, one or more outer inclined surfaces or teeth in the vicinity of the wall or the opening or recess which cooperate with the wall; and wherein the outer inclined surfaces or teeth lie inside the channel of the foot part in the rest position of the plates relative to one another but move out of the channel of the foot part and away from one another when displaced into the work position.

2. The fastening device according to claim 1;

wherein the opening or recess is in a thin wall;

wherein the plates have, respectively, at an other end of their longitudinal extension, outer inclined surfaces which cooperate with the edge of the opening in the thin wall; and wherein the outer inclined surfaces lie within the channel of the foot part in the rest position of the plates relative to one another, but move out of the channel of the foot part and away from one another when the plates arc displaced into the working position.

3. The fastening device according to claim 1;

wherein the opening or recess is in a thick wall.

4. The fastening device according to claim 1;

wherein the screw is a headless screw.

5. The fastening device according to claim 1;

wherein the screw is arranged in a threaded bore hole provided in the head part.

6. The fastening device according to claim 1;

wherein the screw is arranged in a threaded bore hole provided in the foot part.

7. The fastening device according to claim 1;

wherein end bevels of the holding elements are inclined with respect to a wall plane of the wall in such a way that, when a force component perpendicular to the wall plane is directed away from the latter, the holding elements are displaced against a spring force of the compression spring in a direction parallel to the wall plane.

8. The fastening device according to claim 1;

wherein end bevels of the holding elements are inclined with respect to a wall plane of the wall in such a way that, when a force component perpendicular to the wall plane is directed away from the latter, the holding elements are not displaced parallel to the wall plane against a spring force of the compression spring.

9. The fastening device according to claim 1, further comprising:

a rectangular auxiliary plate having a rectangular aperture that is smaller in longitudinal direction and/or in transverse direction than an aperture in the wall .

10. The fastening device according to claim 1;

wherein the inclined surfaces of the plates which arc displaceable relative to one another, cooperate with the conical screw and are arranged in such a way that when the conical screw is tightened the plates are moved away from one another against a spring force of the compression spring, but when the conical screw is loosened the plates are moved toward one another by the spring force.

11. The fastening device according to claim 1;

wherein the inclined surfaces of the plates which arc displaceable relative to one another, cooperate with the conical screw and are arranged in such a way that when the conical screw is tightened the plates are moved toward one another against a spring force of the compression spring, but when the conical screw is loosened the plates are moved away from one another by the spring force.

12. The fastening device according to claim 1;

wherein end bevels of the holding elements each include:

a first region which is inclined with respect to the wall plane in such a way that, when a force component perpendicular to the wall plane is directed away from the wall plane, the holding elements are displaced against a spring force of the compression spring; and a second region which is inclined with respect to the wall plane at a smaller angle which is inclined with respect to the wall plane, so that, when the force component perpendicular to the wall plane is directed away from the wall plane, the holding elements are not displaced against the spring force of the compression spring.

13. The fastening device according to claim 12;

wherein the two end bevels of the holding elements, with their different inclinations with respect to the wall plane, are arranged in such a way that, when the foot part is pulled out, the region which is not self-locking becomes operative first and the self-locking region becomes operative only afterward.

14. The fastening device according to claim 1;

wherein the fastening device is part of a hinge for a door.

15. The fastening device according to claim 1;

wherein the fastening device is part of a handle for a wall or a door.

16. The fastening device according to claim 1;

wherein the fastening device is part of a closure for a door.

17. The fastening device according to claim 1;

wherein the fastening device is part of a device that is provided with a head and used for fastening a first wall to a second wall.

18. The fastening device according to claim 1;

wherein an outer inclined surface for fastening the fitting to the wall is roughened, scored, or grooved to achieve a partial positive engagement and, as the case may be, for grounding.

19. The fastening device according to claim 1;

wherein the edge of the opening of the wall that is struck by the inclined surface of the fastening element is beveled for adapting to the inclination of the inclined surface so as to reduce contact stress.

20. The fastening device according to claim 1;

wherein when the fastening elements are arranged one behind the other, and a free space located between the fastening elements is used for arranging fitting devices.

21. The fastening device according to claim 8;

wherein the screw with conically shaped region is screwed in only to release the fitting.

22. The fastening device according to claim 21;

wherein the screw with conically shaped region has the shape of a tool with or without a screw fitted thereto.

23. A clampable fastening device for mounting fittings or other objects in an opening or recess of a wall, said fastening device comprising:

a head part which is to be arranged in a mounted position on a one outer side of the wall and which is intended to cover an outer rim of the opening or recess, a foot part which, in the mounted position, proceeds from the head part, and which is penetrable through the opening or which is projectable into the recess; and holding elements which are displaceable relative to one another, against or with a spring force, in a channel formed in the foot part;

wherein the holding elements project from the foot part along direction of an outer surface of the foot part;

wherein a free end of each of the holding elements has an inclined surface for supporting the foot part without play on a rim or edge of the opening of an other inner side of the wall, or each of the free ends of the holding elements has obliquely arranged points for penetrating into the wall surface of the opening or recess of the wall;

wherein the foot part and the holding elements are separate parts; wherein the holding elements are displaceable in a direction of displacement along the channel by means of a screw having a conically shaped region;

wherein the holding elements are plates which are arranged next to one another and are elongated in the direction of displacement, where the plates jointly form with the channel walls a receiving space for receiving a compression spring which provides the spring force;

wherein the receiving space extends in the direction of displacement and becomes smaller when the plates are displaced from a rest position and, as a result, compresses the spring;

wherein the conically shaped region of the screw includes a conically shaped foot;

wherein each of the plates has, near an end of the respective plate other than the respective free end, a first inner inclined surface and a second inner inclined surface, where at least one of the first inner inclined surface and the second inner inclined surface cooperates with the conical foot;

wherein the first inner inclined surfaces are offset with respect to one another in the rest position of the plates but move towards each other when the plates are displaced into a working position; and wherein, for each plate, the second inner inclined surface adjoins the first inner inclined surface in such a way that the two inclined surfaces form a free space receiving the conical region of the screw.

24. The fastening device according to claim 23;

wherein the opening or recess is in a thin wall;

wherein the plates have, respectively, at an other end of their longitudinal extension, outer inclined surfaces which cooperate with the edge of the opening in the thin wall; and wherein the outer inclined surfaces lie within the channel of the foot part in the rest position of the plates relative to one another, but move out of the channel of the foot part and away from one another when the plates are displaced into the working position.

25. The fastening device according to claim 23;

wherein the opening or recess is in a thick wall;

wherein the plates have, at a respective other end of the longitudinal extension, one or more outer inclined surfaces or teeth in the vicinity of the wall or the opening or recess which cooperate with the thick wall; and wherein the outer inclined surfaces or teeth lie inside the channel of the foot part in the rest position of the plates relative to one another but move out of the channel of the foot part and away from one another when displaced into the work position.

26. The fastening device according to claim 23;

wherein the screw is a headless screw.

27. The fastening device according to claim 23;

wherein the screw is arranged in a threaded bore hole provided in the head part.

28. The fastening device according to claim 23;

wherein the screw is arranged in a threaded bore hole provided in the foot part.

29. The fastening device according to claim 23;

wherein end bevels of the holding elements are inclined with respect to a wall plane of the wall in such a way that, when a force component perpendicular to the wall plane is directed away from the latter, the holding elements are displaced against a spring force of the compression spring in a direction parallel to the wall plane.

30. The fastening device according to claim 23;

wherein end bevels of the holding elements are inclined with respect to a wall plane of the wall in such a way that, when a force component perpendicular to the wall plane is directed away from the latter, the holding elements are not displaced parallel to the wall plane against a spring force of the compression spring.

31. The fastening device according to claim 23, further comprising:

a rectangular auxiliary plate having a rectangular aperture that is smaller in longitudinal direction and/or in transverse direction than an aperture in the wall.

32. The fastening device according to claim 23;

wherein the inclined surfaces of the plates which are displaceable relative to one another, cooperate with the conical screw and are arranged in such a way that when the conical screw is tightened the plates are moved away from one another against a spring force of the compression spring, but when the conical screw is loosened the plates are moved toward one another by the spring force.

33. The fastening device according to claim 23;

wherein the inclined surfaces of the plates which are displaceable relative to one another, cooperate with the conical screw and are arranged in such a way that when the conical screw is tightened the plates are moved toward one another against a spring force of the compression spring, but when the conical screw is loosened the plates are moved away from one another by the spring force.

34. The fastening device according to claim 23;

wherein end bevels of the holding elements each include:

a first region which is inclined with respect to the wall plane in such a way that, when a force component perpendicular to the wall plane is directed away from the wall plane, the holding elements are displaced against a spring force of the compression spring; and a second region which is inclined with respect to the wall plane at a smaller angle which is inclined with respect to the wall plane, so that, when the force component perpendicular to the wall plane is directed away from the wall plane, the holding elements are not displaced against the spring force of the compression spring.

35. The fastening device according to claim 34;

wherein the two end bevels of the holding elements, with their different inclinations with respect to the wall plane, are arranged in such a way that, when the foot part is pulled out, the region which is not self-locking becomes operative first and the self-locking region becomes operative only afterward.

36. The fastening device according to claim 23;

wherein the fastening device is part of a hinge for a door.

37. The fastening device according to claim 23;

wherein the fastening device is part of a handle for a wall or a door.

38. The fastening device according to claim 23;

wherein the fastening device is part of a closure for a door.

39. The fastening device according to claim 23;

wherein the fastening device is part of a device that is provided with a head and used for fastening a first wall to a second wall.

40. The fastening device according to claim 23;

wherein an outer inclined surface for fastening the fitting to the wall is roughened, scored, or grooved to achieve a partial positive engagement and, as the case may be, for grounding.

41. The fastening device according to claim 23;

wherein the edge of the opening of the wall that is struck by the inclined surface of the fastening element is beveled for adapting to the inclination of the inclined surface so as to reduce contact stress.

42. The fastening device according to claim 23;

wherein when the fastening elements are arranged one behind the other, and a free space located between the fastening elements is used for arranging fitting devices.

43. The fastening device according to claim 30;

wherein the screw with conically shaped region is screwed in only to release the fitting.

44. The fastening device according to claim 43;

wherein the screw with conically shaped region has the shape of a tool with or without a screw fitted thereto.

* * * * *